US006585065B1

(12) United States Patent
Frejaville

(10) Patent No.: US 6,585,065 B1
(45) Date of Patent: Jul. 1, 2003

(54) WHEELED BOARD

(75) Inventor: Pierre Frejaville, Limours (FR)

(73) Assignees: Marcel Bellens (FR); Franck Mauvignier (FR)

( * ) Notice: Subject to any disclaimer, the term of this patent is extended or adjusted under 35 U.S.C. 154(b) by 0 days.

(21) Appl. No.: 09/699,121

(22) Filed: Oct. 27, 2000

Related U.S. Application Data

(63) Continuation of application No. PCT/FR99/01026, filed on Apr. 29, 1999.

(30) Foreign Application Priority Data

Apr. 29, 1998 (FR) ..... 98/05366

(51) Int. Cl.[7] ..... B60K 1/00; B62M 1/00; B62K 1/00; B62B 13/00

(52) U.S. Cl. ..... 180/65.1; 280/87.01; 280/264; 280/22.1; 280/28.11

(58) Field of Search ..... 180/65.1, 333, 180/907; 280/87.043, 264, 282, 28.11, 21.1, 22, 22.1, 88, 778, 93.502, 87.01, 8, 7.14; 188/5, 7, 8

(56) References Cited

U.S. PATENT DOCUMENTS

| | | | | | |
|---|---|---|---|---|---|
| 662,475 | A | * | 11/1900 | Strickland | 180/6.26 |
| 1,710,849 | A | * | 4/1929 | Watson | 280/88 |
| 1,894,160 | A | * | 1/1933 | Clark | 280/88 |
| 2,353,501 | A | * | 7/1944 | Redling | 280/21.1 |
| 2,913,250 | A | * | 11/1959 | La Fever | 280/87.01 |
| 3,275,093 | A | * | 9/1966 | Pawl | 180/77 |
| 3,590,934 | A | * | 7/1971 | Wappler | 180/6.2 |
| 4,757,871 | A | * | 7/1988 | Steimer | 180/273 |
| 4,790,460 | A | | 12/1988 | Harper, Jr. | |
| 5,090,716 | A | | 2/1992 | Borden | |
| 5,130,693 | A | | 7/1992 | Gigandet | |
| 5,261,291 | A | * | 11/1993 | Schoch et al. | 74/484 R |
| 5,667,229 | A | * | 9/1997 | Wenger | 280/22 |
| 6,116,622 | A | * | 9/2000 | Gibbons | 280/16 |

FOREIGN PATENT DOCUMENTS

| | | | | |
|---|---|---|---|---|
| DE | 3407888 A | * | 9/1985 | 280/21.1 |
| DE | 85 19 231 | | 12/1985 | |
| DE | 195 42 061 A1 | | 5/1997 | |
| EP | 0117901 | * | 11/1983 | 280/21.1 |
| EP | 0 304 585 A1 | | 3/1989 | |
| WO | WO 89/02301 | | 3/1989 | |
| WO | WO 93/08884 | | 5/1993 | |

* cited by examiner

*Primary Examiner*—Brian L. Johnson
*Assistant Examiner*—Gerald Klebe
(74) *Attorney, Agent, or Firm*—Piper Rudnick LLP

(57) ABSTRACT

A vehicle including a platform, a braking and steering system fitted onto the platform including a handle movable along two substantially perpendicular axes to control steering by moving the handle with respect to a first of said axes and to control braking by moving the handle with respect to a second of said axes, and two guiding wheels mounted on independent pivoting axles connected by a steering rod, the steering rod being connected to an intermediary connecting rod connected to the control handle.

14 Claims, 4 Drawing Sheets

WHEELED BOARD

RELATED APPLICATION

This is a continuation of International Application No. PCT/FR99/01026, with an international filing date of Apr. 29, 1999, which is based on French Patent Application No. 98/05366, filed Apr. 29, 1998.

FIELD OF THE INVENTION

This invention pertains to a light, compact four-wheeled vehicle that can transport a seated or kneeling person, comprising a board, a steering and braking system and a safety system that automatically brakes the wheeled board.

BACKGROUND

The existing vehicles associated with this market have a steering system operated by the displacement of the user's mass or by handlebars, a cord or a steering bar which is directly operated by the hands or feet. As an example, known in the state of the art is WO 93/08884 which describes a recreational vehicle which is a wheeled platform fitted with wheels operated by handlebars.

U.S. Pat. No. 4,790,460 describes a wheeled board equipped with carrying straps. DE 8519231.7 describes a steering system for wheeled vehicles. U.S. Pat. No. 5,130,693 describes a wheeled vehicle equipped with an acoustic device. U.S. Pat. No. 5,090,716 describes a wheeled platform equipped with a control handle. WO 89/02301 describes a wheeled vehicle presenting a wing-shaped platform. These vehicles are not completely satisfactory because of their reduced handling ability.

Also known is U.S. Pat. No. 5,667,229 pertaining to a sled with a steering and braking system operated by a handle that is movable in two perpendicular directions.

The braking systems are often nonexistent and there is no safety system to stop the vehicle if the user should lose control. There is no directly associated system to facilitate transport of the vehicle. These vehicles are often unstable and do not allow a very responsive control of their movements.

Although very responsive joystick type control handles are employed in virtual games, they are not used in the vehicles employed in real games.

SUMMARY OF THE INVENTION

A vehicle including a platform, a braking and steering system fitted onto the platform including a handle movable along two substantially perpendicular axes to control steering by moving the handle with respect to a first of the axes and to control braking by moving the handle with respect to a second of the axes, and two guiding wheels mounted on independent pivoting axles connected by a steering rod, the steering rod being connected to an intermediary connecting rod connected to the control handle.

BRIEF DESCRIPTION OF THE DRAWINGS

The attached drawings illustrate the invention.

DETAILED DESCRIPTION OF THE INVENTION

Figure 1:
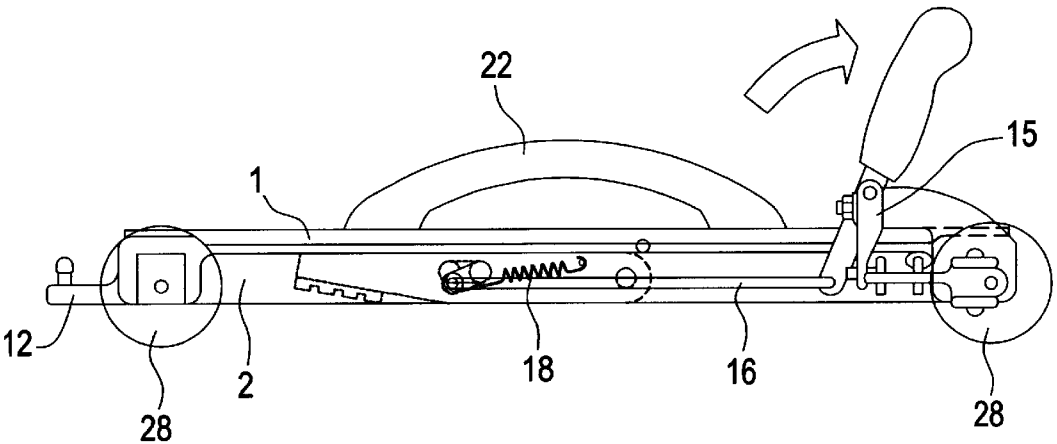
FIG. 1 shows the wheeled board in a side view, with the brake handle pushed forward and the brake retracted.
Figure 2:
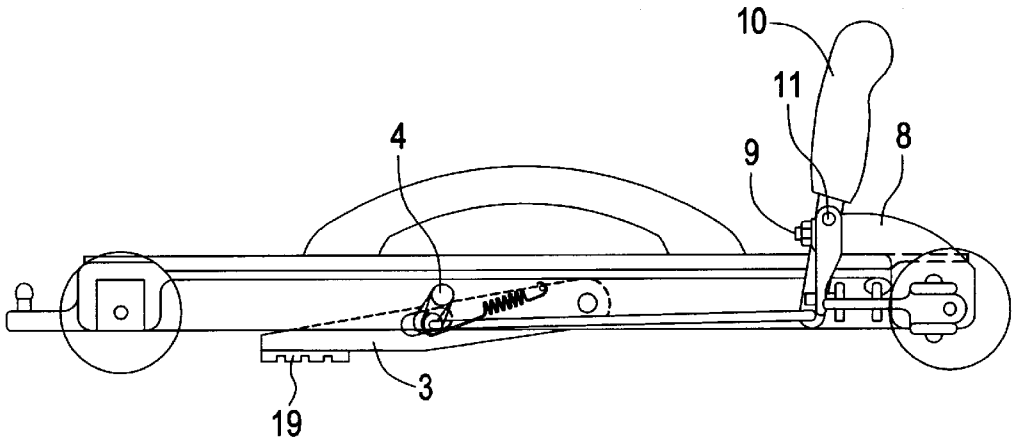
FIG. 2 shows the wheeled board in a side view, with the brake protruding.
Figure 3:
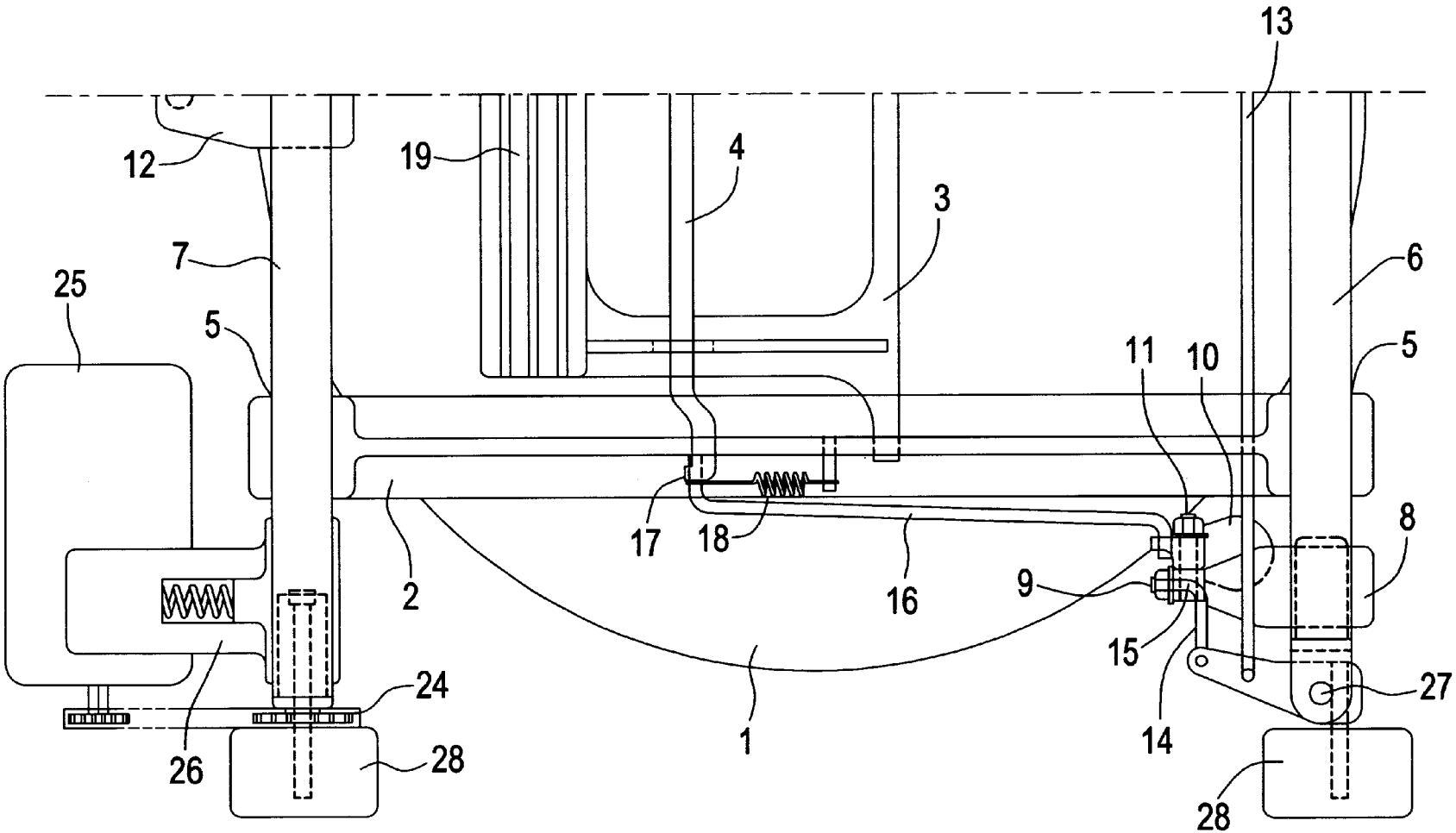
FIG. 3 shows half of the wheeled board from below.
Figure 4:
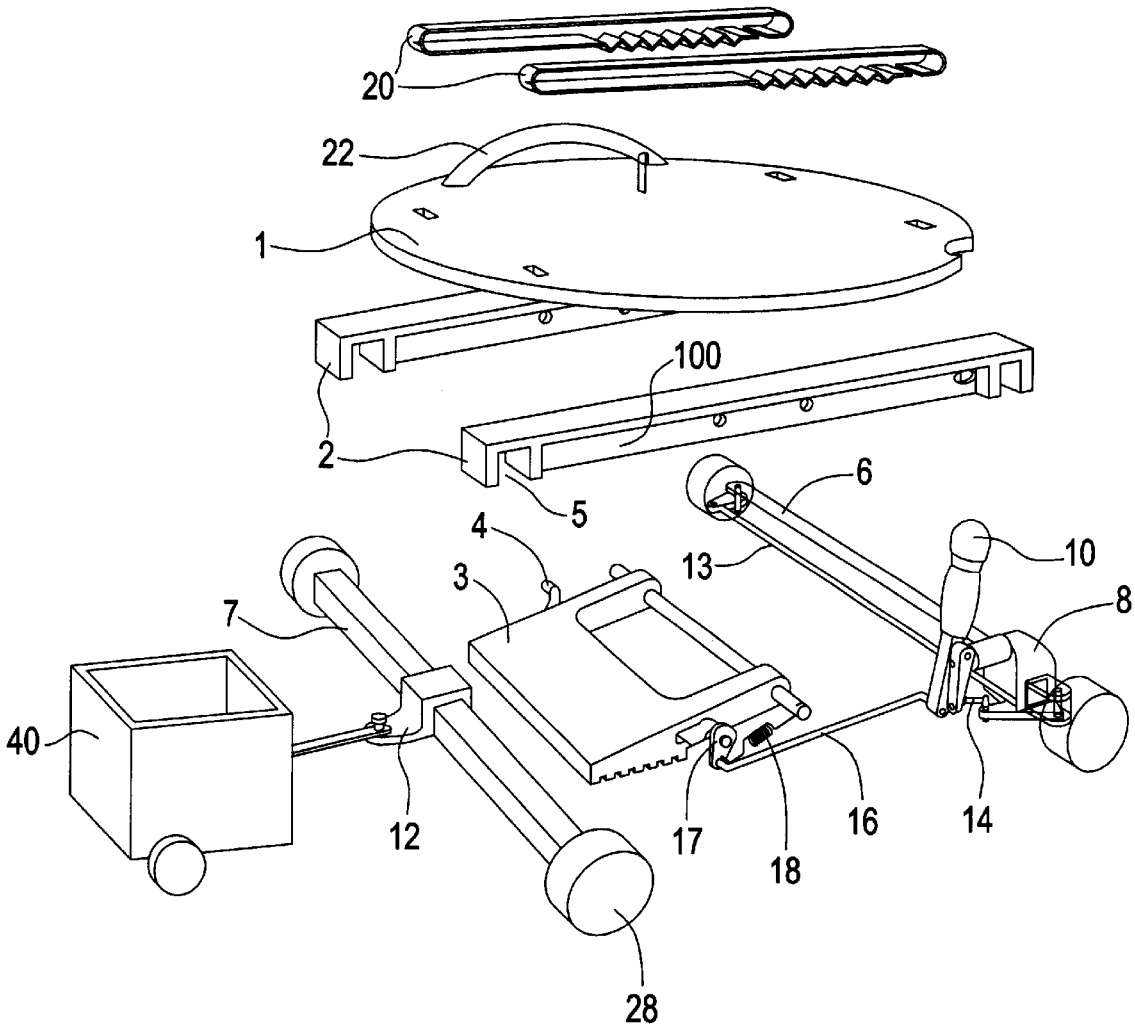
FIG. 4 shows an exploded perspective view of the wheeled board.
Figure 5:
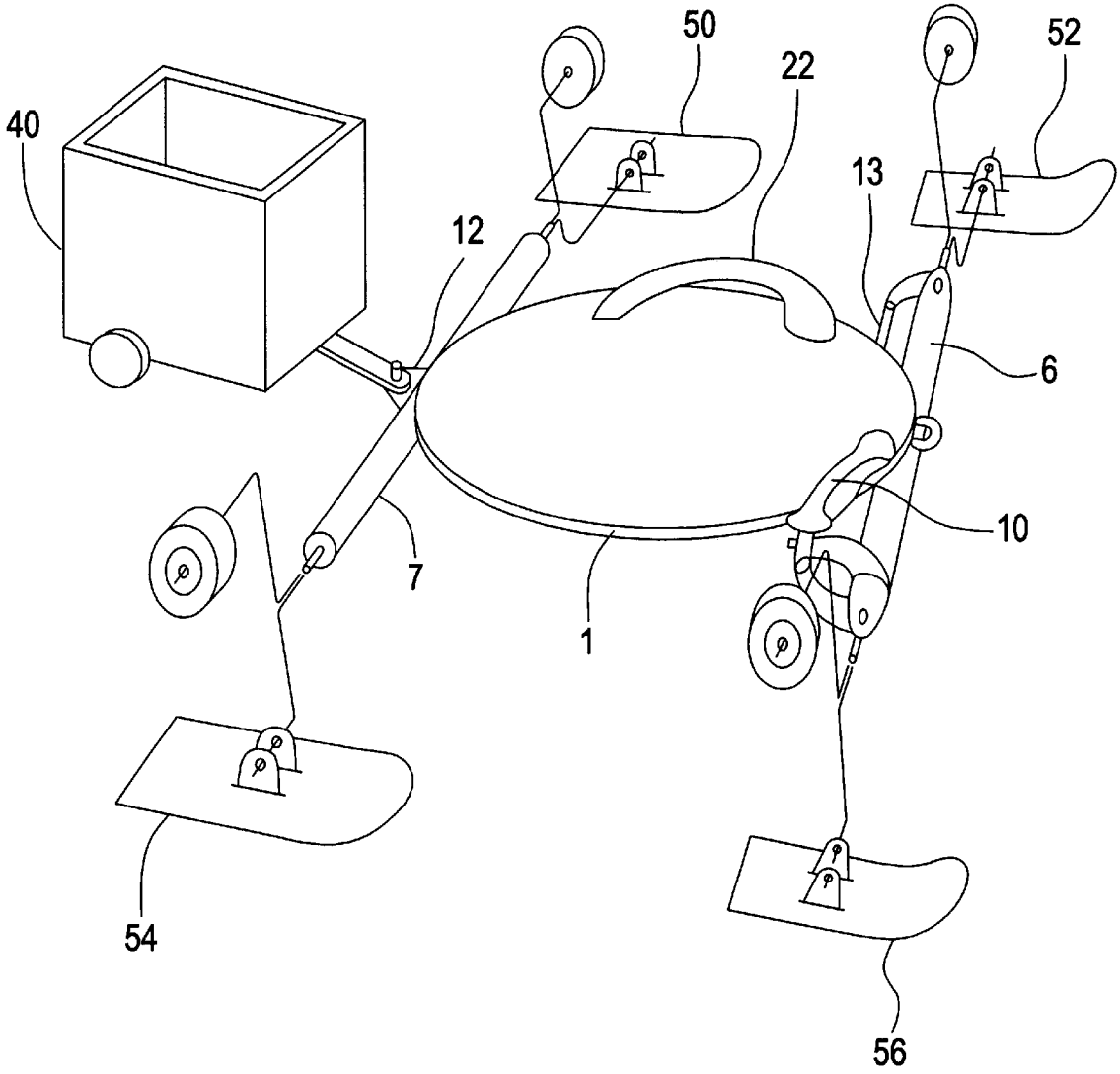
FIG. 5 shows an exploded perspective view of the board with guiding skis.

The following description is intended to refer to specific embodiments of the invention illustrated in the drawings and is not intended to define or limit the invention, other than in the appended claims. Also, the drawings are not to exact scale and various dimensions and proportions are contemplated.

The invention pertains to a light, compact four-wheeled vehicle that allows the user to descend inclined planes and, if it is equipped with a motor, to ascend inclined planes or to roll on flat surfaces. More particularly, it comprises a board on which one can sit, kneel or lie down, four wheels of which two are guiding wheels on independent pivoting axles connected by a steering rod which is itself connected via a connecting rod to a joystick type control handle, which makes it possible to steer by pivoting to the right or the left, and a fixed support handle on the board.

In its most general meaning, the invention pertains to a wheeled vehicle constituted by a platform fitted with braking means and steering means, characterized in that it comprises a handle that can be moved along two perpendicular axes to operate the steering system by moving the handle with respect to a first axis and to operate the braking system by moving the handle along an axis that is substantially perpendicular to the first axis.

According to two specific modes of implementation: It is possible to add a brake that contacts the ground and pivots in relation to the board, which brake is operated via a camshaft connected via a lever and a connecting rod to the control handle, such that the vehicle can be braked by pulling back on the handle. It is possible to add a spring which forces the brake to intensely contact the ground if the control handle is not pushed forward It is possible to add a hook or trailer hitch that can receive a trailer. It is also possible to add a trailer which is similar to the base vehicle but without its steering function and front wheel-axle unit.

Two retractable straps can be fixed on the board to allow it to be backpacked. A motor assembly can be simply fixed and the motor control connected to a trigger close to the thumb position of the support handle.

Turning now to the drawings, the wheeled board is composed of a board that can optionally be oval or round (1) fixed on two rails (2) that comprise the chassis. Rails (2) have a lateral housing (100) enclosing brake toggle (3) and camshaft (4) which are assembled directly and articulated in rails (2).

Rails (2) also comprise transverse notches (5) for perpendicularly fixing a front tube/axle (6) and a rear tube/axle (7). The front tube allows fixation of pivoting axes (27) on which are articulated the hubs of the front wheels. A U casing (8) attached to the right or the left on the front tube receives an axle (9) enabling attachment of handle (10) and its second rotational axle (11). Handle (10) can be moved along two substantially perpendicular axes. A first longitudinal axis enables actuation of steering rod (13) for pivoting the front wheels to the right and left. A second transverse axis enables moving handle (10) from front to back to operate the braking system.

The rear tube (7) receives a central casing (12) fitted with a hook for the addition of a trailer 40. A steering rod (13) connects the two front hubs and an articulated connecting rod (14) connects one of the hubs to the inferior end of the support (15) of the second axis of handle (10). Another articulated connecting rod (16) connects the lower end of handle (10) to lever arm (17) of camshaft(4). One end of a draw spring (18) is fixed to the end of the lever of the camshaft and the other end is fixed to the rail. It, therefore, forces the brake to contact or rub the ground if the handle is not pushed forward. An elastomer shoe (19) is fixed under brake toggle (3). There are four slits in the board to allow passage of two straps (20) for backpacking. On the back of the board (chassis side), one end of each belt is fixed on the board directly while the other end is fixed on an elastic roller equipped with a stop. The other end of the roller is fixed on the chassis. A support handle (22) is fixed on the side of the board opposite the steering handle.

The trailer is implemented like the wheeled board except that it does not have front hubs, pivot axis or steering bar. The mobile handle can be rotated on only one axis which allows braking to be implemented by a movement from front to back.

A female hook casing is fixed to the front while the rear of the trailer is identical to the wheeled board and thus allows hitching up another trailer and so on. Thus, the entire assembly can form a train of a steerable wheeled board and multiple trailers equipped with independent brakes.

A driving pinion (24) can be fixed on one of the two rear wheels, a motor assembly (25) can be fixed simply by means of a clip (26) which can be locked on one side of rear tube (7) and drive the wheel pinion via the intermediary of a chain or a timing belt. The accelerator cable or the electric contact switch is connected to a trigger which is positioned at the site of the thumb of the hand that holds the fixed handle.

The fabrication of this board allows for the possibility of reversing the two handles for left-handed users. In the context of games and recreational activities, this wheeled board is easily controllable. It does not require noteworthy dexterity for slow, conventional driving. The road-holding and braking capability make this a reassuring vehicle. The liveliness of the steering and the lightness of the vehicle provide a genuine driving experience. Given its weight and its size, this vehicle can be carried everywhere: in the hand like a suitcase, on the back, in the trunk of a car, and the like.

By adding thermal or electric motorization, it is possible to compete directly with Karts but at lower purchase, maintenance and transport costs, and with sensations that are at least as impressive. Under certain traffic conditions, the wheeled board can be an economical and nonpolluting (electric) means of transportation.

Although this invention has been described with reference to specific forms of apparatus and method steps, it will be apparent to one of ordinary skill in the art that various equivalents may be substituted, the sequence of steps may be varied, and certain steps may be used independently of others, all without departing from the spirit and scope of the invention defined in the appended claims.

What is claimed is:

1. A vehicle adapted to roll on a surface comprising:

a platform;

a braking and steering system fitted onto the platform including a handle movable along two substantially perpendicular axes to control steering by moving the handle with respect to a first of said axes and to control braking by moving the handle with respect to a second of said axes, wherein said braking and steering system is provided with a spring that biases said system into a braking position against the surface;

two guiding wheels mounted on independent axles that pivot, connected by a steering rod, the steering rod being connected to an intermediary connecting rod connected to said handle and wherein the handle is located adjacent one of the wheels.

2. The vehicle according to claim 1, further comprising a support handle fixed on the platform.

3. The vehicle according to claim 1, wherein the braking system includes a brake pivotable with respect to the platform into a braking position and is operated by a camshaft connected by a lever and a connecting rod to the handle, whereby braking the vehicle is caused by pivoting the handle.

4. The vehicle according to claim 3, wherein said biased braking position is maintained until said handle is pushed forward along said second axis.

5. The vehicle according to claim 1, further comprising a hook sized and shaped to receive a trailer.

6. The vehicle according to claim 5, further comprising a trailer without front wheels and without steering capability.

7. The vehicle according to claim 1, further comprising two retractable straps fixed to the platform.

8. The vehicle according to claim 1, further comprising a motor assembly operatively connected to propel the vehicle.

9. The vehicle according to claim 1, further comprising two rails connected to the platform and fitted to a front axle and rear axle.

10. The vehicle according to claim 9, wherein the front and rear axles are fitted to the two rails and axles are connected together by a flexible joint thereby allowing a chassis, formed from the two rails and the two axles, to bend so as to absorb surface irregularities.

11. The vehicle according to claim 1, wherein the guiding wheels are located on an end portion of the vehicle proximate the handle and the vehicle further comprises two following wheels located on an end portion of the vehicle remote from the handle.

12. The vehicle according to claim 1, wherein the handle can be moved to simultaneously affect turning and braking.

13. A sled adapted to slide on a surface comprising:

a platform;

a braking and steering system fitted onto the platform including a handle movable along two substantially perpendicular axes to control steering by moving the handle with respect to a first of said axes and to control braking by moving the handle with respect to a second of said axes, wherein said braking and steering system is provided with a spring that biases said system into a braking position against the surface; and two guiding skis mounted on independent axles that pivot, connected by a steering rod, the steering rod being connected to an intermediary connecting rod connected to said handle and wherein the handle is located adjacent to one of the skis.

14. A vehicle adapted to roll on a surface comprising:

a platform;

a braking and steering system fitted onto the platform including a handle movable along two substantially perpendicular axes to control steering by moving the handle with respect to a first of said axes and to control braking by moving the handle with respect to a second of said axes, wherein said braking and steering system is provided with a spring that biases said system into a braking position against the surface;

two guiding wheels mounted on independent axles that pivot, connected together by a steering rod, the steering rod being connected to an intermediary connecting rod connected to said control handle and wherein the handle is located adjacent to one of the wheels; and two rails connected to the platform, each of said rails having notches to receive a front axle and a rear axle.

* * * * *